US005417015A

United States Patent [19]

Coyne

[11] Patent Number: 5,417,015

[45] Date of Patent: May 23, 1995

[54] PIVOTAL GUTTER FOR EASY CLEANING

[76] Inventor: Robert S. Coyne, 32950 Ledge Hill, Solon, Ohio 44139

[21] Appl. No.: 135,597

[22] Filed: Oct. 13, 1993

[51] Int. Cl.[6] ..... E04D 13/072; E04D 13/064

[52] U.S. Cl. ..... 52/11; 52/16; 16/382; 16/387; 16/388; 16/389; 248/48.2; 294/19.1

[58] Field of Search ..... 52/11, 12, 13, 14, 15, 52/16; 16/382, 387, 388, 389; 248/48.1, 48.2; 294/19.1, 24

[56] References Cited

U.S. PATENT DOCUMENTS

| | | | |
|---|---|---|---|
| 2,843,063 | 7/1958 | Thomson | 52/11 |
| 3,076,669 | 2/1963 | Schlein | 52/16 X |
| 3,239,172 | 3/1966 | Chalmers | 52/11 X |
| 3,858,267 | 1/1975 | Swannie | 294/19.1 X |
| 4,072,285 | 2/1978 | Greenwood | 52/11 X |
| 4,309,792 | 1/1982 | Faye | 52/11 X |
| 4,311,292 | 1/1982 | Deason | 52/11 X |
| 4,561,616 | 12/1985 | Robinson | 248/48.2 |
| 4,669,232 | 6/1987 | Wyatt | 52/11 |
| 4,837,987 | 6/1989 | Fender | 52/11 |
| 5,184,435 | 2/1993 | Sherman | 52/12 |
| 5,274,965 | 1/1994 | Jackson | 52/11 |
| 5,317,843 | 6/1994 | Sheehan | 52/11 |
| 5,335,460 | 8/1994 | Smith, Jr. | 52/11 |

FOREIGN PATENT DOCUMENTS

| | | | |
|---|---|---|---|
| 1-247641 | 10/1989 | Japan | 52/11 |

*Primary Examiner*—Carl D. Friedman
*Assistant Examiner*—Kevin D. Wilkens
*Attorney, Agent, or Firm*—Renner, Kenner, Greive, Bobak, Taylor & Weber

[57] ABSTRACT

A pivotal rain gutter facilitates easy cleaning thereof. In one embodiment the device has a hinge assembly which is secured to a structural support. A trough is secured to the hinge assembly using a single fastener. The trough is also supported by a retaining strap which is secured to the structural support and may be engaged and disengaged from the trough. The trough may thereby be pivoted down for ease of cleaning. A pole effector facilitates engaging and disengaging of the retaining strap. A flexible downspout allows the gutter to be pivoted up and down without disconnecting the downspout.

11 Claims, 5 Drawing Sheets

PIVOTAL GUTTER FOR EASY CLEANING

TECHNICAL FIELD

The invention herein resides in the art of rain gutters and, more particularly, to a rain gutter which is secured to the eaves of a dwelling. Specifically, the invention pertains to such a rain gutter which is secured to the dwelling by a hinge assembly and retaining strap that allows the gutter to be pivoted down for easy cleaning.

BACKGROUND ART

It is well known that rain gutters secured to the eaves of dwelling structures tend to become filled with accumulated debris over a period of time. Such accumulations necessitate that the rain gutter be cleaned periodically. Cleaning of fixed rain gutters often is awkward and laborious and frequently requires the use of ladders or scaffolds to provide access to the gutters. Previously, it has been known to secure the gutters to the structure in such a way as to allow the gutter to be tilted or pivoted downward to facilitate removal of accumulated debris from the ground. However, such previously known structures often involve elaborate manipulating mechanisms and are difficult to assemble. Moreover, many of the known structures suffer from poor support and all require removal of the down spout prior to tilting the gutter. Another drawback is that previously known hinge mechanisms are mounted in such a way that they are constantly exposed to leakage from the gutter thereby reducing the hinge's working life due to rust or oxidation. Accordingly, the prior art techniques and structure have been difficult to use and costly to maintain.

There is clearly a need in the art for a pivotal rain gutter that is easy to assemble, easily tilted for cleaning, and well supported from the dwelling structure.

DISCLOSURE OF THE INVENTION

In light of the foregoing, it is a first aspect of the invention to provide a rain gutter for a dwelling structure.

Another aspect of the invention is the provision of a rain gutter which can be tilted downward for cleaning.

Yet a further aspect of the invention is the provision of a rain gutter which is sturdily supported from the dwelling structure.

Still a further aspect of the invention is the provision of a rain gutter which is inexpensive to manufacture and easy to use, while being reliable and durable in operation.

The foregoing and other aspects of the invention which will become apparent as the detailed description proceeds, are achieved by the improvement in a pivotal rain gutter, comprising: a structural support; trough means; a plurality of hinge assemblies mounted to the structural support; a plurality of retaining straps also mounted to the structural support; and a plurality of fasteners which secure the trough to each of the hinge assemblies whereby the retaining strap when engaged with the trough prevents the trough from pivoting down and when disengaged allows the trough to pivot down.

BRIEF DESCRIPTION OF THE DRAWINGS

For a complete understanding of the objects, techniques, and structure of the invention reference should be made to the following detailed description and accompanying drawings wherein.

PREFERRED EMBODIMENT FOR CARRYING OUT THE INVENTION

Figure 1:
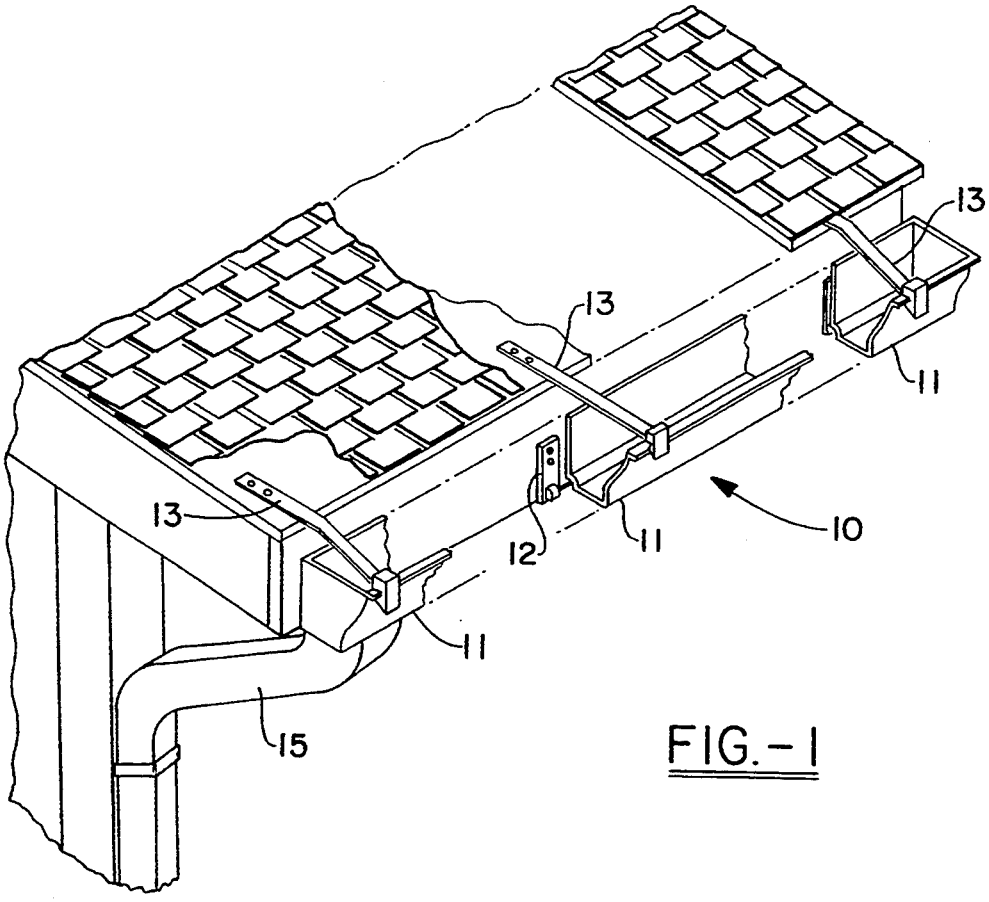
FIG. 1 is a perspective view of the improved rain gutter showing the same mounted on the eave of a dwelling structure.
Figure 2:
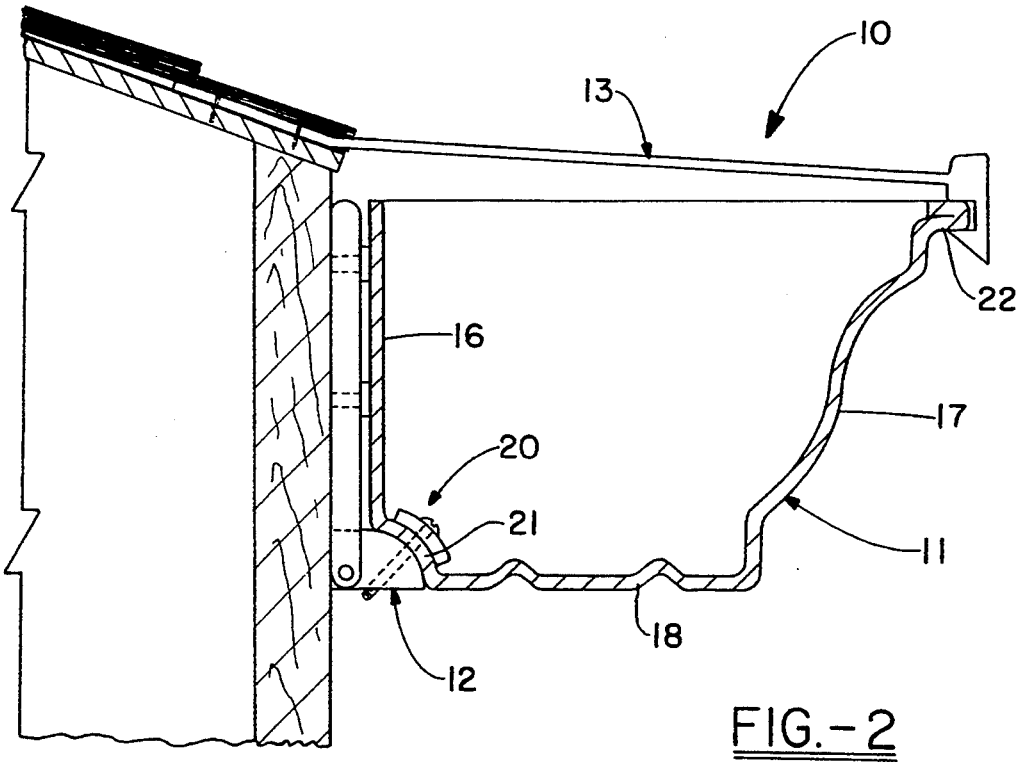
FIG. 2 is a side elevational view taken along a section through longitudinal axis thereof.

Referring now to the drawings and more particularly to FIG. 1, it can be seen that the pivotal rain gutter according to the invention is designated generally by the numeral 10. As can be seen, the pivotal rain gutter 10 is comprised of a conventional style trough 11, a hinge assembly 12, a retaining strap 13 and a downspout 15. Referring now to FIG. 2 it can be seen that the trough 11 is of a generally conventional cross section having a back wall 16, a front wall 17, and a bottom 18. The bottom 18 and back wall 16 are joined at the lower rear corner 20 by an arcuate matching web 21. The front wall 17 terminates at its upper extremity in a flange 22 which is substantially perpendicular to the back wall 16. The trough 11 is preferably extruded from an appropriate plastic or metal such as aluminum.

Figure 3:
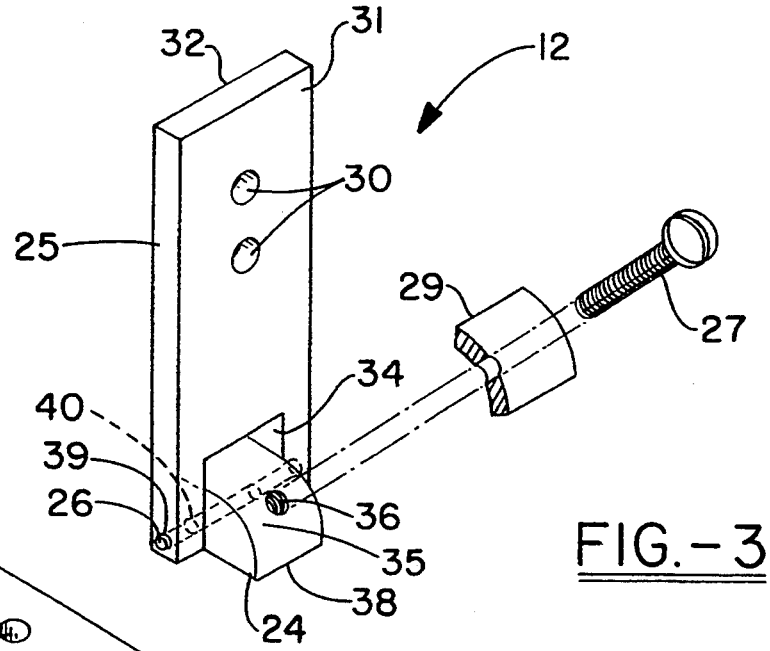
FIG. 3 is a perspective view of the improved hinge assembly.
Figure 4:
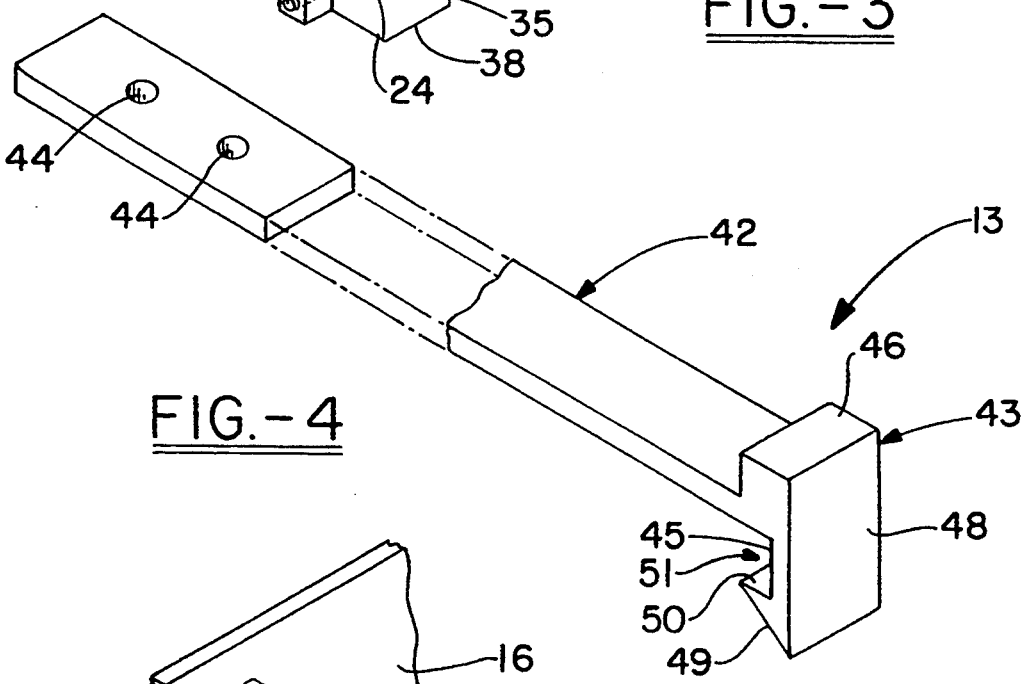
FIG. 4 is a perspective view of the improved retaining strap.

With reference to FIG. 3 it can be seen that the hinge assembly 12 is comprised of a base plate 24, a mounting plate 25, a roll pin 26, a screw 27 and a grommet 29. The mounting plate 25, base plate 24, and grommet 29 are preferably manufactured from an appropriate thermoplastic material, while the screw 27 and roll pin 26 are preferably manufactured from an appropriate metal. The mounting plate 25 is of a generally rectangular shape and has a pair of mounting apertures 30 which penetrate the front face 31 through to the rear face 32. The apertures 30 are basically centered left to right, one above the other, proximal to the upper end of the mounting plate 25. A rectangular receiving notch 34 is cut out of the lower end of the mounting plate 25. The base plate 24 is a generally rectangular block having an arcuate upper face 35 of substantially the same radius as the arcuate matching web 21 of the trough 11. The arcuate upper face 35 of the base plate 24 further includes a screw aperture 36, which is angled at approximately 45° relative to the bottom face 38 of the base plate 24. This aperture 36 receives a self-tapping screw 27 for attachment of the trough 11 to the hinge assembly 12. The base plate 24 is mounted in the receiving notch 34 at the mounting plate 25, by means of the roll pin 26. The roll pin 26 engages the mounting plate 25 through the roll pin apertures 39 which penetrate the mounting plate 25 laterally at a point near the bottom of the base plate 25. The roll pin 26 traverses the receiving notch 34 thereby engaging the base plate 24 which also includes a roll pin aperture 40. The base plate 24 may then pivot about the roll pin axis relative to the mounting plate 25. As can be seen from FIG. 4, the retaining strap 13 is comprised generally of a fillet 42 and a head 43. The fillet 42 includes a pair of fastener apertures 44 which receive appropriate fasteners, such as screws or nails for attachment to the dwelling structure. The head 43 is generally perpendicular to the fillet 42 and includes a top face 46 a front face 48 and a slanted bottom face 49. The bottom face 49 is slanted at an approximate 45° angle relative to the front face 48 and terminates at a notch face 50 which connects the bottom face 49 with the rear face 45 thereby forming a notch 51.

Figure 5:
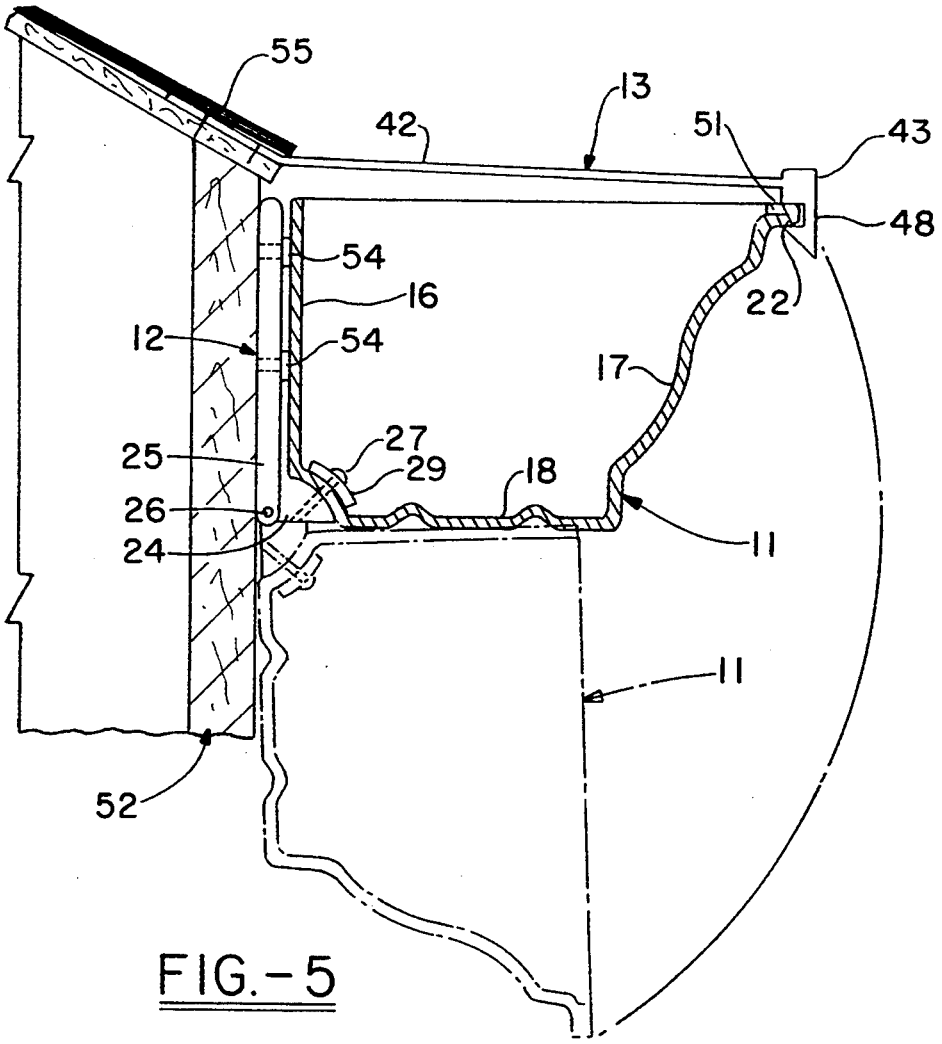
FIG. 5 is a side elevational view taken along a section through the longitudinal axis thereof.

Assembly of the present invention is accomplished according to FIG. 5. As can be seen the hinge assembly 12 is mounted to the eave facia 52 of the dwelling structure by securing the mounting plate 25 thereto with self-tapping screws 54 or other appropriate fasteners. The hinge assembly 12 may be spaced at regular intervals along the length of the eave facia 52. It has been found that spacing the hinge assemblies 12 approximately three feet apart provides adequate support for the trough 11 with a minimum amount of hardware. The trough 11 may then be mounted to the hinge assemblies 12 by means of a self-tapping screws 27. The grommet 29 is interposed between the interior of the arcuate matching web 21 of the trough 11 and the screw 27. The arcuate matching web 21 having substantially the same radius as the arcuate upper face 35 of the base plate 24 matingly fits therewith.

As should be apparent to those skilled in the art, the trough 11 is easily secured to the structure using only a single screw 27 for each hinge assembly. Further, installation of the screws 27 is facilitated by the angle of the screw aperture 36. This angle prevents interference between the installation tool and the trough front wall 17. The grommet 29 ensures that the hinge assembly 12 is protected against water leakage from the trough 11. Additionally, passage of the screw 27 through the web 21 is at a point elevated above the bottom 18 such that standing water in the rain gutter 10 will typically be of an insufficient level to weep through the hole receiving the screw 27 and pass to the hinge assembly 12. The convex arcuate nature of the web 21 also assures that water will not be retained adjacent the screw 27 and its opening in the web 21.

Figure 7:
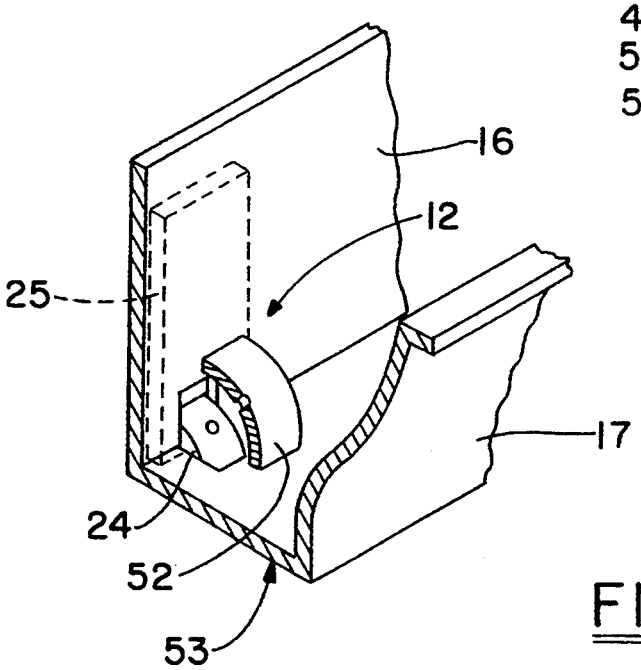
FIG. 7 is a perspective view of a conventional trough used in conjunction with the improved adapter the same being shown in section.
Figure 6:
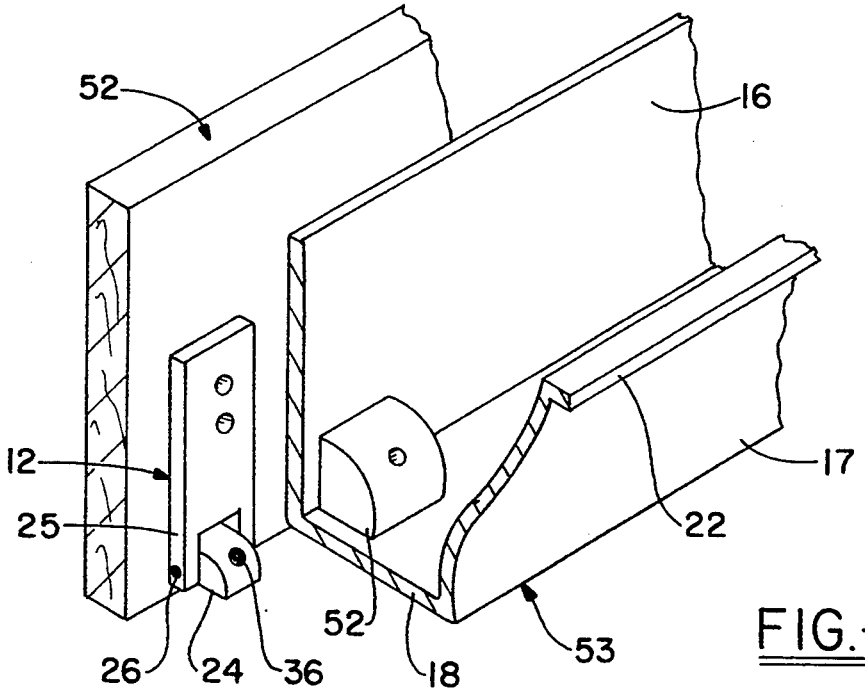
FIG. 6 is a partially expanded perspective of a conventional trough used in conjunction with the improved adapter.

It is contemplated that the hinge assembly 12 may by used with conventional troughs. An adapter 52 is therefore provided to facilitate such use. With reference now to FIGS. 6 and 7, it can be seen that a conventional trough 53 may be modified by removing a portion thereof from the lower rear corner such that the base plate 24 may be received therein. The adapter 52 may then be fitted over the base plate 24. The grommet 29 and screw 27 may then be installed as described above. As is apparent, the adapter 52 fits snugly in the interior of the trough 53. However, a bead of an appropriate sealant such as silicon or latex caulking may be applied around the adapter 52 as further insurance against leakage, if so desired.

Once mounting of the trough 11 has been accomplished, the retaining strap 13 may be secured to the structure. The fillet 42 is inserted under the first row of shingles 55, the trough 11 is then pivoted into the up position and the notch 51 is allowed to engage the flange 22 of the trough 11. This ensures that the retaining strap 13 is in the proper position to support the trough 11. The strap 13 may then be mounted to the roof by means of self-tapping screws, roofing nails or other appropriate fasteners. As should be apparent, the best support for the trough 11 is achieved by spacing the retaining straps 13 at intervals representing the midpoint between the hinge assemblies 12. This method provides greater support than prior art systems which use a one-piece mounting bracket, as it allows the trough 11 to be supported at multiple points, preferably one every one and a half feet. Accordingly, the retaining straps 13 maintain the trough 11 in the up position by engaging the flange 22 of the trough 11.

Those skilled in the art will appreciate that the number of components, i.e., retaining straps 13 and hinge assemblies 12 needed for a particular installation depend largely on the length of the trough to be installed and the degree of support desired.

Figure 8:
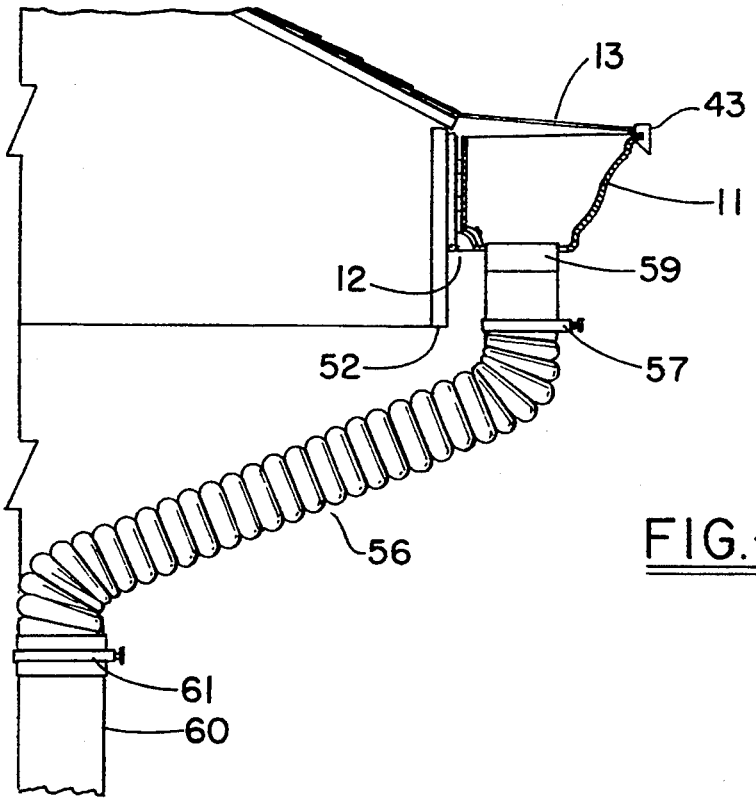
FIG. 8 is a side elevation of the improved downspout being used in conjunction with the improved gutter.

A flexible downspout 15 is provided according to FIG. 8. The accordion style downspout is preferably fabricated from an appropriate thermoplastic material. As can be seen, a pressure clamp 57 secures one end of the downspout 15 to a rigid downspout insert 59, mounted in the trough 11. The other end of the downspout 15 is secured to a conventional rigid downspout 60 by a second pressure clamp 61. The flexible downspout 56 thereby provides communication between the trough 11 and the rigid downspout 60, while allowing the trough 11 to be pivoted downward for cleaning without disconnecting the downspout.

Figure 9:
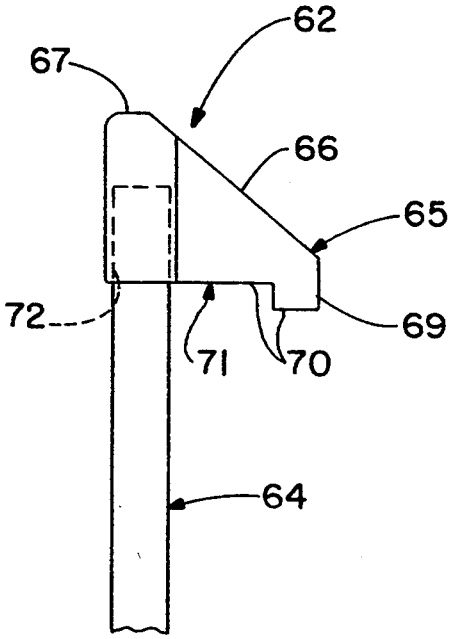
FIG. 9 is a side elevational view of the improved pole effector.
Figure 10:
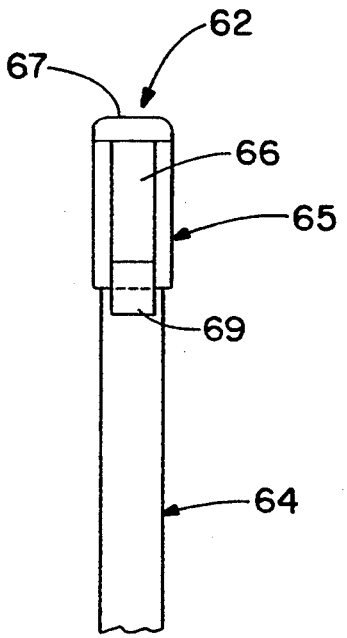
FIG. 10 is a front elevation of the improved pole effector.
Figure 11:
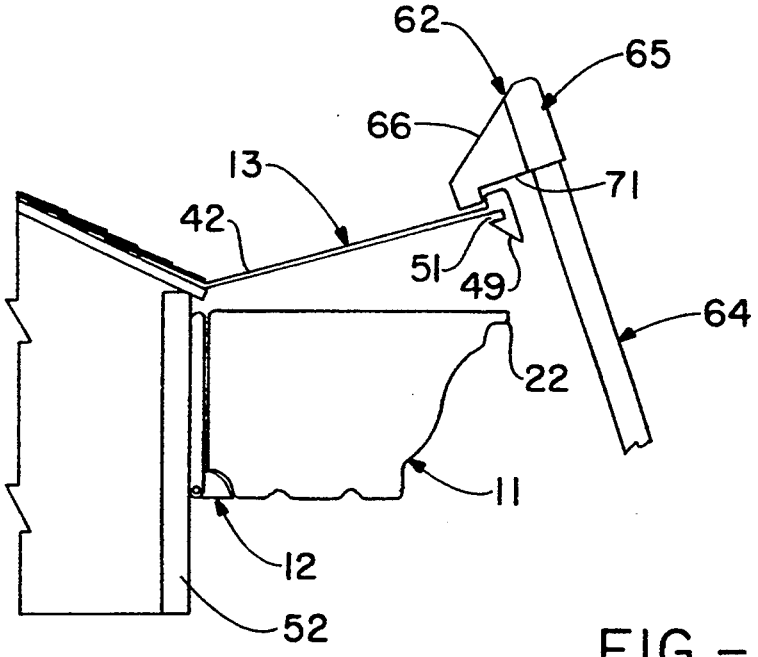
FIGS. 11 and 12 are side elevations showing the pole effector being used in conjunction with the improved gutter.
Figure 12:
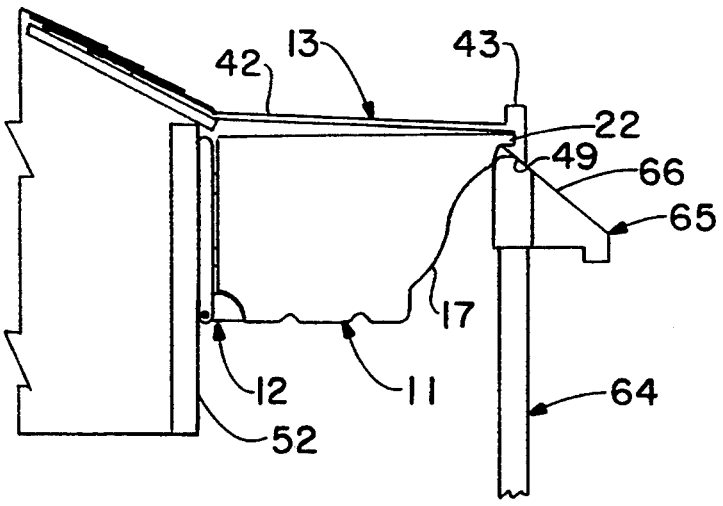

The present invention also provides a pole effector 62 (shown in FIGS. 9 and 10) for engaging and disengaging the retaining straps 13. The pole effector 62 is comprised of a shaft 64 and a head 65. The shaft 64 may be manufactured as a single piece from a solid or hollow plastic or other appropriate material such as wood or aluminum, but it is preferred that the shaft 64 be manufactured as a two piece tubular structure wherein the tubes telescope one within the other. Accordingly, the shaft 64 may be lengthened or shortened for the individual using the effector and for eaves at various heights. The head 65 is characterized by a slanted face 66 which connects the upper face 67 with the front face 69. The front face 69 is substantially parallel with the length of the shaft 64 and is perpendicular to the upper face 67. A lower face 70 is indented so as to form an engaging notch 71. The head 65 further includes a shaft aperture 72 which matingly receives the end of the shaft 64. As can be seen in FIG. 11, the pole effector 62 may be used to bring the retaining straps 13 into locking engagement with the trough 11. Such is accomplished by simply placing the head 65 of the pole effector 62 over the head 43 of the retaining strap 13 and pulling downward on the shaft 64. The notch 71 of the pole effector 62 engages the rear face 45 of the retaining strap 13 thereby preventing the pole effector 62 from slipping off while effecting engagement of the strap 13 with the trough 11. Similarly, FIG. 12 depicts the pole effector 62 in use to effect disengagement of the retaining strap 13 from the trough 11. As shown, the head 65 of the pole effector 62 is inserted between the bottom face 49 of the retaining strap 13 and the front wall 17 of the trough 11. Upward pressure exerted on the pole effector 62 causes the head 65 to wedge, thereby forcing the head 43 of the retaining strap 13 to flex outward. Accordingly, the trough 11 is disengaged from the retaining strap 13. As should be apparent, the use of the pole effector 62 according to the present invention allows the user to manipulate the gutter 10 from the ground without the need for ladders or scaffolds.

Those skilled in the art will now recognize that the present invention allows one to remove accumulated debris from the trough 11 by simply disengaging the retaining straps 13 and allowing the trough 11 to pivot downward on the hinge assemblies 12. The flexible downspout 56 need not be removed and debris may be flushed from the trough 11 by using an ordinary garden hose.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention, reference should be made to the following claims.

I claim:

1. In a pivotal rain gutter, the improvement comprising:

a structural support;

trough means;

a plurality of hinge means mounted to said structural support; said hinge means comprising, a mounting plate having a plurality of fastening apertures and at least one roll pin aperture, a base plate having an arcuate upper face, an angled fastener aperture, and a roll pin aperture, and a roll pin which secures said base plate to said mount plate a plurality of retaining means also mounted to said structural support and in selective engagement with said trough means; and a plurality of fastening means which secure said trough to each said hinge means whereby said retaining means when engaged with said trough means prevents said trough means from pivoting down and when disengaged from said trough means allows said trough means to pivot down.

2. The improvement in a pivotal rain gutter as recited in claim 1, wherein said pivotal rain gutter further comprises flexible down spout means which allows said trough to be pivoted down without disconnecting the downspout.

3. The improvement in a pivotal rain gutter as recited in claim 2, wherein said flexible downspout means is comprised of:

an accordion style flexible hose;

a rigid downspout member;

at least two pressure clamps; and a rigid downspout insert received in said trough means and connected to one end of said flexible hose using one of said clamps and the other end of said flexible hose is connected to said rigid downspout member using another of said clamps.

4. The improvement in a pivotal rain gutter as recited in claim 1, wherein said pivotal rain gutter further comprises effector means for engaging and disengaging said retaining means and said trough means.

5. The improvement in a pivotal rain gutter as recited in claim 4, wherein said effector means comprises:

a head having a front face, a slanted face, an upper face, a lower face and a shaft aperture; and a shaft which is secured in said shaft aperture, said head being adapted engage said retaining means to engage and disengage said retaining means from said trough.

6. The improvement in a pivotal rain gutter as recited in claim 1, wherein said trough means comprises:

a front wall having a flange;

a back wall;

a bottom; and an arcuate matching web which connects said back wall to said bottom.

7. The improvement in a pivotal rain gutter as recited in claim 6, wherein said retaining means comprises:

a head having a top face, a front face, a slanted bottom face and a notch; and a fillet connected to said head having a plurality of fastening apertures which is mounted to said structural support and said notch of said head engages said flange of said trough to lockingly support said trough in an upright position.

8. The improvement in a pivotal rain gutter as recited in claim 1, wherein said structural support is the eave of a dwelling.

9. The improvement in a pivotal rain gutter as recited in claim 1, wherein said fastening means are self tapping screws.

10. The improvement in a pivotal rain gutter as recited in claim 1, wherein said hinge means and retaining means are separate and distinct from each other.

11. The improvement in a pivotal rain gutter as recited in claim 10, wherein said hinge means and retaining means are laterally spaced along said trough means.

* * * * *